US006983054B2

(12) United States Patent
Cheng

(10) Patent No.: US 6,983,054 B2
(45) **Date of Patent: *Jan. 3, 2006**

(54) MEANS FOR COMPENSATING REAR SOUND EFFECT

(75) Inventor: Eric Cheng, Taipei (TW)

(73) Assignee: C-Media Electronics Inc., Taipei (TW)

( * ) Notice: Subject to any disclaimer, the term of this patent is extended or adjusted under 35 U.S.C. 154(b) by 496 days.

This patent is subject to a terminal disclaimer.

(21) Appl. No.: 10/014,010

(22) Filed: Dec. 10, 2001

(65) Prior Publication Data

US 2003/0108216 A1 Jun. 12, 2003

(51) Int. Cl.
*H04R 5/02* (2006.01)
*H04R 1/10* (2006.01)
*H04R 5/00* (2006.01)

(52) U.S. Cl. ..... 381/309; 381/74; 381/17; 381/300

(58) Field of Classification Search ..... 381/310, 381/309, 17, 307, 300, 98–99, 74
See application file for complete search history.

(56) References Cited

U.S. PATENT DOCUMENTS 6,144,747 A * 11/2000 Scofield et al. ..... 381/309
6,169,806 B1 * 1/2001 Kimura et al. ..... 381/17
6,356,644 B1 * 3/2002 Pollak ..... 381/371
2003/0083024 A1 * 5/2003 Richenstein et al. ..... 455/99
2003/0103637 A1 * 6/2003 Huang ..... 381/309
2004/0109576 A1 * 6/2004 You et al. ..... 381/309
2004/0218775 A1 * 11/2004 Huang ..... 381/371

* cited by examiner

*Primary Examiner*—Laura A. Grier

(74) *Attorney, Agent, or Firm*—Perkins Coie LLP

(57) ABSTRACT

Means for compensating rear sound effect, comprising a headphone-like or an earphone-like device with rear speakers carried therein, the headphone-like or earphone-like device including an opening for receiving the front speaker signal, wherein the headphone-like or the earphone-like device includes a housing for receiving the rear speakers, wherein the housings opposite each other, the two housings being joined by a headband, to compose the headphone-like structure; an input plug with conductive wire connected to the housing; and wherein the earphone-like or headphone-like device cannot cover the whole ear for receiving the sound from the front speakers and sub-woofer speaker, the opening allowing the ears to listen the sound from the front speakers, the rear speakers being respectively located on both sides of the earphone-like or headphone-like device to provide virtual speaker of rear side without losing rear bass.

3 Claims, 5 Drawing Sheets

MEANS FOR COMPENSATING REAR SOUND EFFECT

FIELD OF THE INVENTION

The present invention relates to a device for compensating the rear sound effect, and more specifically, to a device that allows the virtual speaker of rear side to be performed by an earphone-like or headphone-like device.

BACKGROUND OF THE INVENTION

Along with the rapid development of electronic industry, it is not uncommon to play sound effect with advance sound and visual effects on computers anymore. Therefore, the requirement for video and audio performance has become more and more stringent. Except for the need of higher resolution and visual quality, in the field of audio frequency and sound effect, multi-channel sound effect has gradually replaced stereo sound effect and the mono sound effect. In an attempt to provide a more realistic or engulfing listening experience in the home theater, several techniques have developed multi-channel audio formats. Each audio channel of the multi-channel signal is routed to one of several speakers distributed throughout the home theater, providing the sound effect with the sensation that sounds are originating all around them. As the home entertainment system market expands, other multi-channel systems will likely become available to home consumers. Humans are able to localize a sound to the right or left based on arrival time and sound level differences discerned by each ear.

Head related transfer functions (HRTFs) are used to simulate positional and virtual images three-dimensional (3-D) sound using fixed speaker locations. The shape of the human head, body and auditory system affect how the brain perceives the position of sound sources. An HRTF is a characterization of the human head, body and auditory system. Thus, the HRTF is affected by the size and shape of the head, the size and shape of the pinnae, the characteristics of the ear canal. The HRTF is typically a function of both frequency and relative orientation between the head and the source of the sound field. The HRTF accounts for the frequency response, frequency filtering, delays and reflections inherent in the human head. By adjusting the frequency and delays of audio signals according to the HRTF, three-dimensional sound can be simulated from fixed speaker locations. U.S. Pat. No. 5,729,612 entitled "Method and apparatus for measuring head-related transfer functions", which disclosed a method for accurately deriving acoustic transfer functions such as head-related transfer functions at low cost. The prior art is filed on Aug. 5, 1994.

A unique HRTF can be calculated for each individual by performing detailed and time-consuming measurements of the head, ear and body. The measurements taken for an individual are converted to a transfer function usable by a processing device to adjust the characteristics of audio signal outputs to individual earphones to simulate positional three-dimensional sound.

Because HRTF simulates the sound effect model heard by a human ear in a three-dimensional space and the parameters corresponding to the three-dimensional sound effect at every spot of the space are determined by its distance, azimuth, and elevation, the listener feel like within the real atmosphere of the sound while playing the sound effect. The Head Related Transfer Function uses an artificial head or put microphones within human ears. Each sound source has to be measured from 20 HZ~20 KHZ and the result is preliminary HRTF library. The preliminary HRTF library, via mathematical process, generates parameters needed by DSP digital filter. As long as mono wave sound is processed by the left and the right digital filters, it can emulate 3D positional audio by means of earphones.

HRTF 3D Positional Audio in PC Applications includes simulating multi-speaker Surround with two physical speakers to deliver five "virtual speakers" into space surrounding the listener and enabling home theater sound effects. However, the 5.1 CH DVD or 4 CH 3D game uses HRTF to create virtual speakers on rear side to replace physical speaker for DVD and 3D game meets some problems. The ear-phone device does not have the ability to offer good bass. The bass wavelength is longer than the size of human head, thus there is no direct information on bass due to the structure of the earphone device. Bass speaker called sub-woofer speaker is good for all channels. It is unfortunately, the rear side bass has to be filtered out from rear signal.

There is a great need for sound control device to overcome the difficulties mentioned above.

SUMMARY OF THE INVENTION

The object of the present invention is to disclose a device for compensating the rear sound effect.

The further object of the present invention is to provide an earphone-like device to provide virtual speaker of rear side.

Means for compensating rear sound effect, comprising:

a headphone-like or an earphone-like device with rear speakers carried therein, the headphone-like or earphone-like device including an opening for receiving the front speaker signal, wherein the headphone-like or the earphone-like device includes a housing for receiving the rear speakers, wherein the housings opposite each other, the two housings being joined by a headband, to compose the headphone-like structure; an input plug with conductive wire connected to the housing; and wherein the earphone-like or headphone-like device cannot cover the whole ear for receiving the sound from the front speakers and sub-woofer speaker, the opening allowing the ears to listen the sound from the front speakers, the rear speakers being respectively located on both sides of the earphone-like or headphone-like device to generate the rear channel sound effect of the virtual speaker of rear side.

Means for compensating rear sound effect, comprising:

main frames for hanging the means on the ears; rear speakers attached on the main frame, the main frames shaped to approximately match the structure of the ears; wherein the main frames opposite each other, the two main frames being joined by wires; an input plug with conductive wire connected to the main frames; and wherein the means for compensating rear sound effect allowing the ear receiving the sound from the front speakers and sub-woofer speaker, the rear speakers being respectively located on both sides of the means for compensating rear sound effect to generate the virtual speaker of rear side with rear bass.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

THE DETAILED DESCRIPTION OF THE PREFERRED EMBODIMENT

Figure 1:
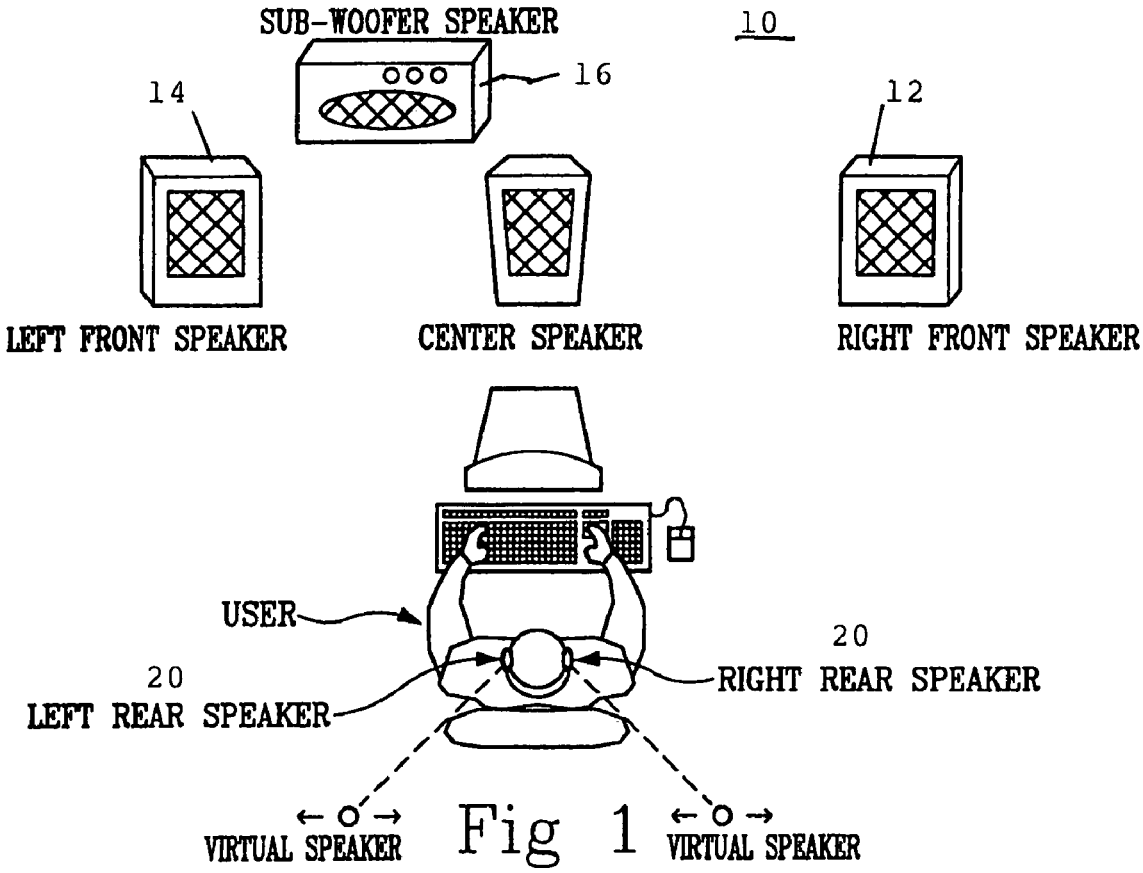
FIG. 1 is scheme illustrating a 5.1 D home theater sound effect system according to the present invention.

Turning to FIG. 1, it illustrates the home theater 5.1D sound effect system 10, the system 10 includes front right 12, front left 14, sub-woofer speakers 16 and rear right, rear left speakers 20. One of the aspects of the present invention is that the rear right, rear left speakers are constructed by an earphone-like or headphone-like device or structure. The feature of the present invention focus on the rear speakers and the control system. It has to be noted that the rear speakers are consisted in the earphone-like structure for user to carry on one's head instead of positing on a certain locations to create the virtual speakers of rear side. The earphone-like or headphone-like device cannot cover the whole ear for receiving the sound from the front speakers and sub-woofer speaker. Thus, there is opening structure to allow the ears to listen the sound from the front speakers. The rear right and rear left speakers are respectively located on both sides of the earphone-like or headphone-like device to create the virtual speakers of rear side sound effect.

Means for creating HRTF is coupled to the rear right and left signal to process the signal that transmitted to the rear right and left speaker carried by the earphone-like or headphone-like structure. It is because that the distant of the rear right and left speaker to the ear is closer than the distant of other speakers. Thus, means for creating virtual speaker of rear side is connected to the means for generating HRTF. Typically, the delay time is approximately D/velocity of sound in the air. The processed signal is fed to the volume controller for adjusting the output volume. HRTF simulates the sound effect model heard by a human ear in a three-dimensional space and the parameters corresponding to the three-dimensional sound effect at every spot of the space are determined by its distance, azimuth, and elevation.

Then, the signal is fed to an amplified therefore output by the rear speakers carried by earphone-like or headphone-like structure. The signal performed by the rear speakers is delay and therefore the ear may receive the signal from the rear speaker and front speaker at the same time. Alternatively, the signal under transmitting to the rear speaker may be emitted by IR or RF. Thus, the earphone-like or headphone-like structure needs the receiver to receive the wireless transmission signal.

Figure 2A:
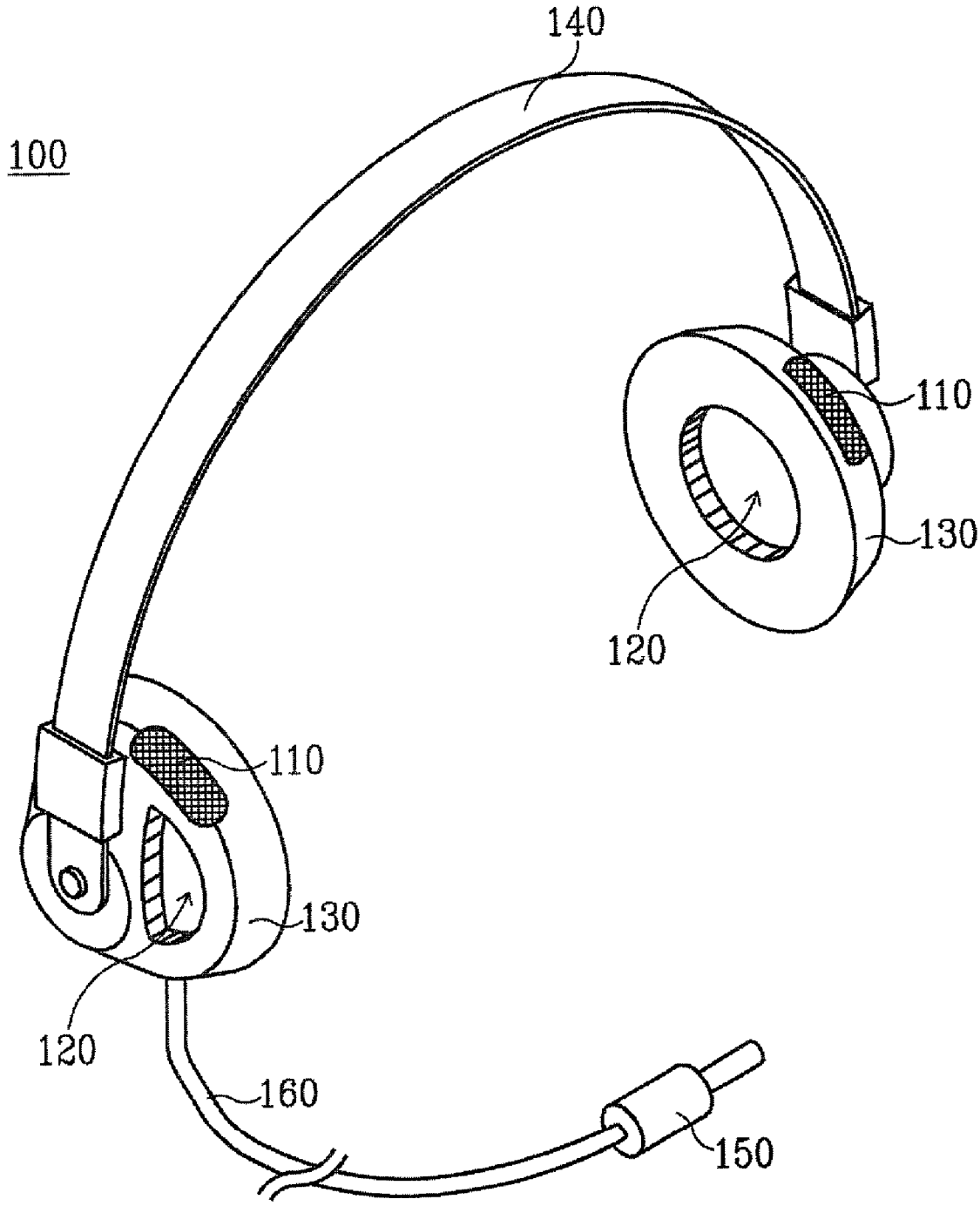
FIGS. 2A–2B are the device with a headphone-like structure according to the present invention.
Figure 2B:
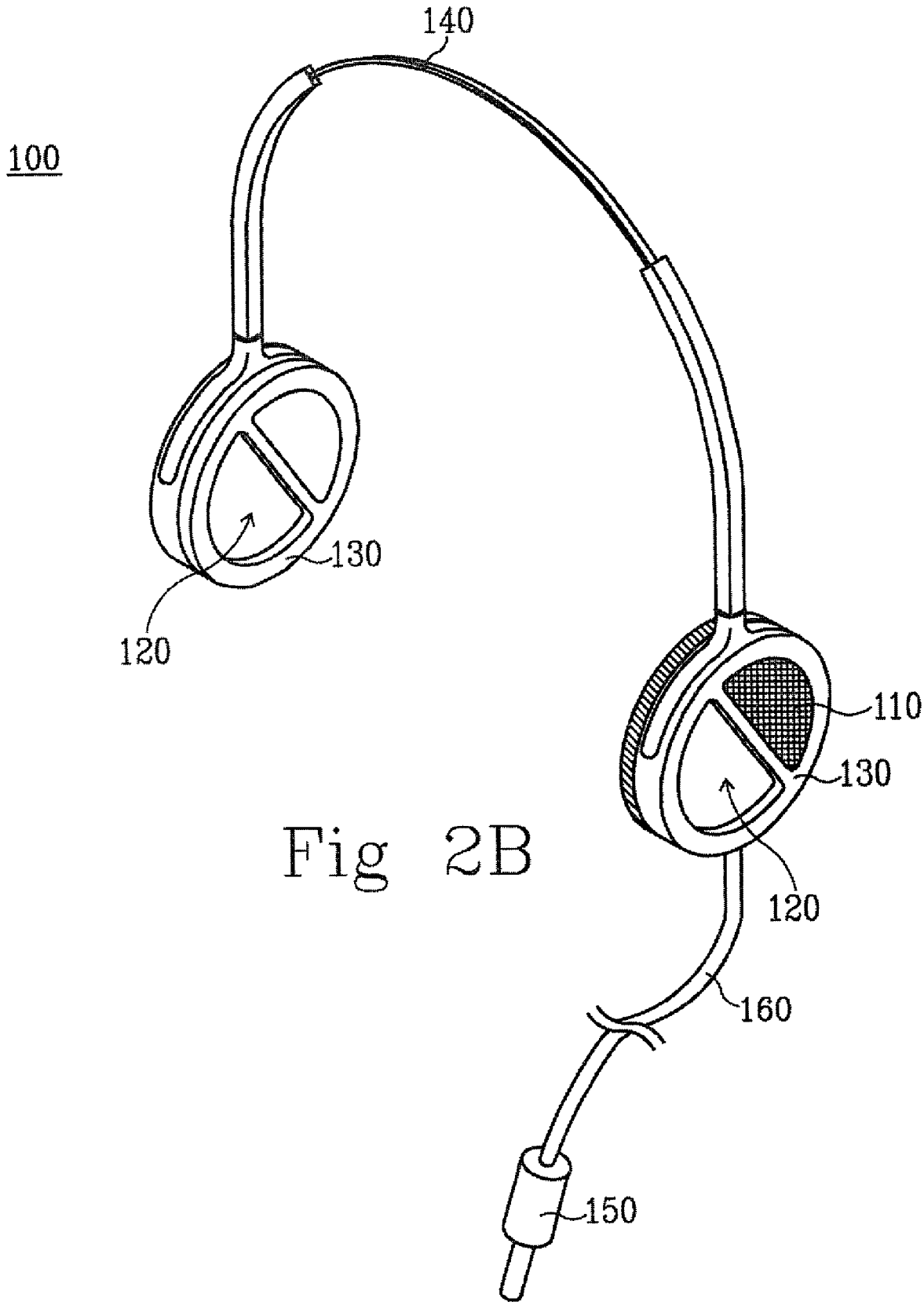

FIGS 2A–2B illustrate the structure according to the present invention. In the present invention, the present invention provides a headphone-like or earphone-like device 100 with rear speakers 110 carried therein. The headphone-like or earphone-like device 100 includes an opening 120 for receiving the front speaker signal. The sound effect system transmits the front, rear and sub-woofer signal to the associated speakers. The signal under transmitting to the rear speakers is delay according to the distance between the user and the front speaker.

The present invention provides a headphone-like or earphone-like device for the user to carry on one's head. The headphone-like device includes a housing 130 for receiving the rear speaker 110. The housings 130 opposite each other, the two housings are joined by a headband 140, to compose a headphone-like device 100. An input plug 150 with conductive wire 160 is connected to the housing 130. If the structure without the transmission line, the housing 130 contains a wireless signal receiver therein.

Figure 3A:
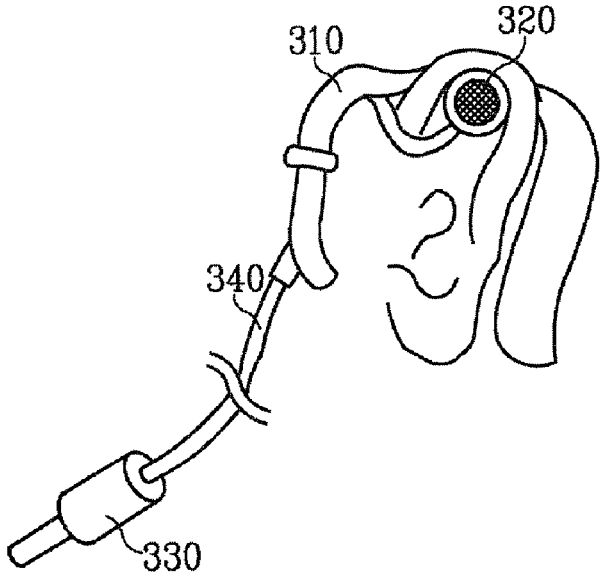
FIGS. 3A–3B are the alternative embodiment according to the present invention.
Figure 3B:
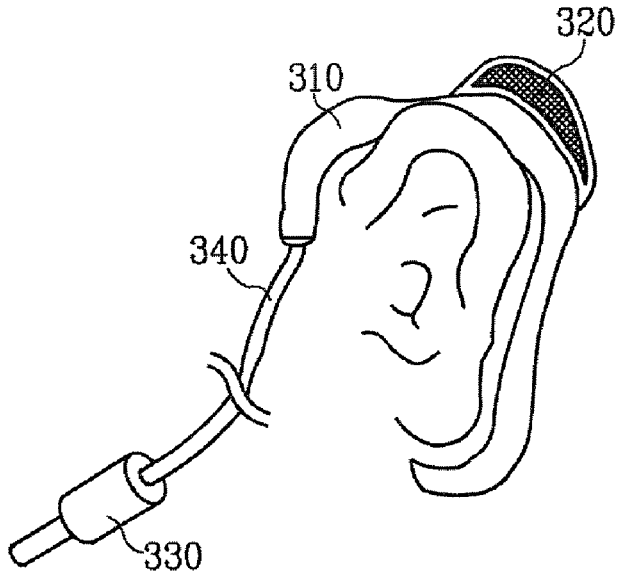
Figure 4A:
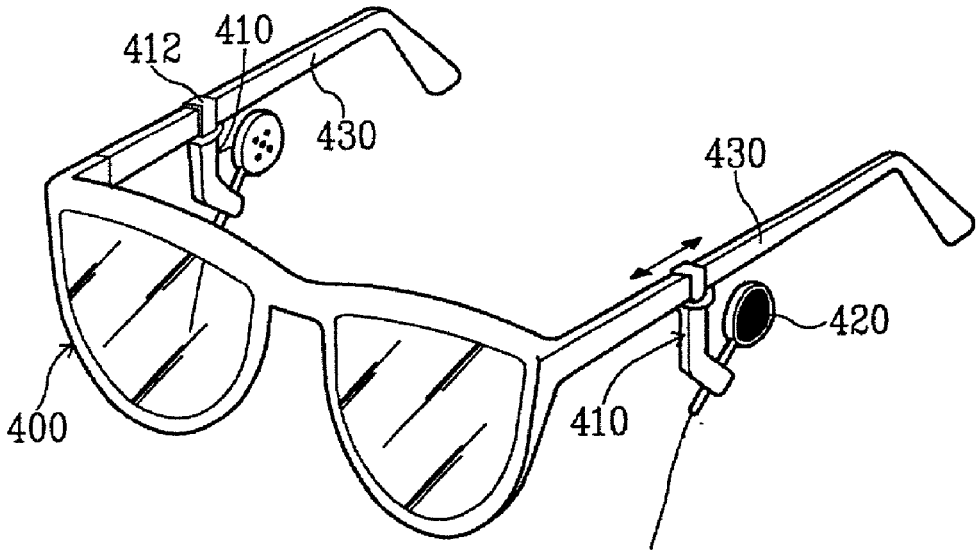
FIGS. 4A–4B are the alternative embodiment according to the present invention.
Figure 4B:
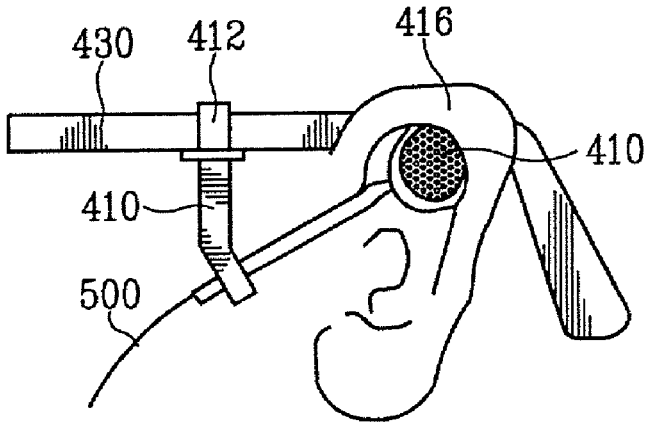

Another structure is illustrated in FIG. 3A-3B, the device includes main frames 310 for hanging the device on the ears. The rear speakers 320 are attached on the suitable position of the main frame 310. The main frames 310 are shaped to approximately match the structure of the ears. The main frames 310 opposite each other, the two main frames 310 are joined by wires 340. An input plug 330 with conductive wire 340 is connected to the main frames 310. FIG. 4 is another alternatively embodiment according to the present invention. The embodiment is useful for the one who wears the eyeglass 400. As shown in FIGS. 4A and 4B, the rear speakers 420 are attached on the eyeglass frame 430. The present invention is attached by slidable adjustable means, such as the elastic loop 412 to a respective one of the frame 430. The adjustable means permits the positioning of the rear speaker support frame 410 along the directions of arrows 15 to a suitable position. Typically, the user wears the eyeglass 400 on the ears 416, the rear speaker 420 extends from the support frame to the upper portion of the ear structure as shown in the FIG. 4B. The rear speaker located at the position will provide better sound effect. An input plug with conductive wire 500 is connected to the support frame 410.

The present invention provides virtual speaker of rear side without concerning the losing of the rear bass.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure. While the preferred embodiment of the invention has been illustrated and described, it will be appreciated that various changes can be made therein without departing from the spirit and scope of the invention.

What is claimed is:

1. Means for compensating rear sound effect, comprising:

two main frames shaped to approximately match the structure of one's ears and opposite to each other, wherein said main frames are joined by wires;

rear speakers located on both said main frames; and an input plug with a conductive wire connected to said main frames;

wherein said means for compensating rear sound effect is a separate headphone or a separate earphone from the front speakers and a sub-woofer speaker and allows said ears receiving the sound from front the speakers and the sub-woofer speaker, outside said means for compensating rear sound effect while said rear speakers provide the sound of rear side virtual speakers without losing rear bass.

2. The means of claim 1, further comprising a means for creating head related transfer functions (HRTF) to simulate positional and virtual images three-dimensional (3-D) sound for processing a signal that transmits to rear right and rear left speakers.

3. Means for compensating rear sound effect for home theater sound effect system, comprising:

a front right speaker, a front left speaker, and a sub-woofer speaker;

a rear right speaker and rear left speaker located on a device including main frames for hanging said device to create virtual speakers of rear side, said device covering partially one's ears to allow said one's ears to receive the sound from said front right, front left speakers and said sub-woofer speaker said main frames being either a separate headphone or a separate earphone from said front right, front left and sub-woofer speakers; and a means for creating head related transfer functions (HRTF) to simulate positional and virtual images three-dimensional (3-D) sound for processing a signal that transmits to said rear right and said left speakers carried by said device.

* * * * *

UNITED STATES PATENT AND TRADEMARK OFFICE

CERTIFICATE OF CORRECTION

PATENT NO. : 6,983,054 B2
DATED : January 3, 2006
INVENTOR(S) : Eric Cheng

It is certified that error appears in the above-identified patent and that said Letters Patent is hereby corrected as shown below:

Column 4,
Line 52, "from front the" should be -- from the front --.

Signed and Sealed this

Thirtieth Day of May, 2006

JON W. DUDAS
*Director of the United States Patent and Trademark Office*